US006775516B2

(12) United States Patent
Kouno

(10) Patent No.: US 6,775,516 B2
(45) Date of Patent: Aug. 10, 2004

(54) SHEET EJECTING DEVICE, CURL ELIMINATING DEVICE AND IMAGE FORMING APPARATUS

(75) Inventor: Yuzo Kouno, Kamagaya (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/231,274

(22) Filed: Aug. 30, 2002

(65) Prior Publication Data

US 2003/0044208 A1 Mar. 6, 2003

(30) Foreign Application Priority Data

Aug. 31, 2001 (JP) ..... 2001-263430
Jan. 17, 2002 (JP) ..... 2002-008572

(51) Int. Cl.[7] ..... G03G 15/00
(52) U.S. Cl. ..... 399/406; 162/271
(58) Field of Search ..... 399/44, 45, 397, 399/406; 162/270, 271, 197; 271/161, 188, 209

(56) References Cited

U.S. PATENT DOCUMENTS

| | | | | |
|---|---|---|---|---|
| 5,594,540 A | | 1/1997 | Higaya et al. | 399/326 |
| 5,678,152 A | | 10/1997 | Kohno et al. | 399/324 |
| 5,787,331 A | * | 7/1998 | Ohkuma et al. | 399/406 |
| 5,832,354 A | | 11/1998 | Kouno et al. | 399/330 |
| 5,915,147 A | | 6/1999 | Kouno et al. | 399/69 |
| 5,920,759 A | * | 7/1999 | Ushiroji et al. | 399/406 |
| 6,320,642 B1 | * | 11/2001 | Ogawa et al. | 355/27 |
| 6,415,130 B1 | * | 7/2002 | Fujiwara et al. | 399/401 |

FOREIGN PATENT DOCUMENTS

| | | |
|---|---|---|
| JP | 60214379 | 10/1985 |
| JP | 03056355 | 3/1991 |
| JP | 04322266 | 11/1992 |
| JP | 07179258 | 7/1995 |
| JP | 2525796 | 11/1996 |
| JP | 10-104890 | 4/1998 |
| JP | 11119489 | 4/1999 |
| JP | 11124269 | 5/1999 |
| JP | 11189363 | 7/1999 |
| JP | 3050633 | 3/2000 |
| JP | 2000086047 | 3/2000 |
| JP | 2000-247526 | 9/2000 |

OTHER PUBLICATIONS

U.S. patent application Ser. No. 10/231,274, Kouno, filed Aug. 30, 2002.

* cited by examiner

*Primary Examiner*—Hoan Tran
(74) *Attorney, Agent, or Firm*—Oblon, Spivak, McClelland, Maier & Neustadt, P.C.

(57) ABSTRACT

A curl eliminating device, which is constructed in a way that can cool the sheet and straighten the curl at the same time without having a large device and without increasing cost. The device has a transporting roller, arranged in a sheet transporting passage; and a plurality of backup rollers, arranged abreast along a circumference of the transporting roller. The backup rollers press-contacts the transporting roller during rotating. The curl eliminating device clamps and transports the sheet in a way that the sheet conforms with the shape of the circumference of the transporting roller. The backup rollers are separately arranged along the circumference of the transporting roller, and a separating distance is set to be changeable. The separating distance is set according to a curl amount of the sheet.

20 Claims, 13 Drawing Sheets

SHEET EJECTING DEVICE, CURL ELIMINATING DEVICE AND IMAGE FORMING APPARATUS

CROSS-REFERENCE TO RELATED APPLICATION

This application claims the priority benefit of Japanese application serial no.2001-263430, filed on Aug. 31, 2001 and 2002-008572, filed on Jan. 17, 2002.

BACKGROUND OF THE INVENTION

1. Field of the Invention

This invention relates in general to a sheet ejecting device, a curl eliminating device and an image forming apparatus, and more specifically relates to a curl straightening structure to straighten the curl created on the sheet.

2. Description of Related Art

Regarding to an image forming apparatus such as a copy machine, a printer, a facsimile or the like, after an electrostatic latent image is formed onto a latent-image-supporter, the electrostatic latent image is then treated in an image visualization of the developing process. The visible image is electrostatically transcribed onto a recording paper which is a recording medium. Then the transcribed visible image is for example heated to fix to obtain a copy or record thing.

A heat roller and a pressure roller, which face-to-face clamps to form a sheet-transporting-passage, are disposed on one of the devices that are used for fixing, and during transportation of the sheet by the tow rollers, a toner image is fixed by the heat roller with heat and pressure.

The fixing of the heat roller is widely used nowadays due to its advantages such as achieving high efficiency and high speed of the heat roller, achieving high conductivity and stability in fixing efficiency, and having simpler structures that are capable of using a sheet-transporting-medium.

When the fixed sheet is ejected to an ejecting tray by ejecting rollers that are disposed near the heat roller and the pressure roller, the sheet will be re-transported to face the resist roller, rather than to face the ejecting tray. Alternatively, when the sheet is being re-transported and reversed to pass the fixing device, the back side of the image formed face can be selected to be re-formed and then to be ejected to the ejecting tray.

The sheet, when passing the fixing device, will expand due to the heat supplied when the sheet passes the rollers installed inside the fixing device, and will contract due to the evaporation of water caused by the heat. At this time a stress range is created and a deformation called curling happens. As a result when ejecting a sheet with curling, the tip of the sheet will hang downward and then a jam is created by the tip protruding and hitting a transporting face of the ejecting tray such the transportation of sheets thereof is obstructed.

The amount curling is proportional to the amount of the toner supplied onto the sheet. For example, the amount of the toner supplied onto the sheet is larger for a full color image than that for a monochrome image. In other words, the expansion/contraction is relatively obvious when the full color image is formed.

Though curling can also be created due to the manufacture of the sheet at the very beginning, curling is generally created when fixing the sheet. Because the inside of the sheet will become crooked due to the transmutation of the sheet when fixing the sheet, and despite each sheet having a similar tendency to crook, the curling in each sheet differs from each other.

If the curling is kept on the sheet, the toner image and the transcribing position of the sheet will not match due to the curling, and then the sheet will hit the parts arranged on the transporting passage causing jams. Furthermore, the consistency of the ends of the ejected sheets (the stacking quality) will be reduced or inconvenience will occur.

In order to straighten the curling of a sheet, some conventional structures are developed as follows: one structure is made in a way that the ejecting rollers, which clamp and transport a sheet, are made face-to-face and the curvature radius of one of the ejecting rollers is extremely smaller than that of the other one, then with the difference in curvature, the sheet will be bent in a direction reverse to the direction of the curl during transporting (such as Japan Laid-Open publication no. He5-162916); another structure is made in a way that, one side of the transporting guide unit is extended in a direction reverse to the direction of the curl to allow the sheet to conform with the shape of the side of the transporting guide unit to straighten the curl during which it moves from the side of the transporting guide unit to the other side within the transporting passage; still another structure is made in a way that eliminating the curl with an orientation so the sheet moves along the guide face of the transporting guide; still another structure is made in a way that to change the position where the sheet is clamped and transported in, and to change the transporting direction in order to straighten the curl (such as Japan Laid-Open publication no. He7-121039, He7-285721, He8-137309 and He8-290857); still another structure in made in a way to straighten the curl by using the circumference of the ejecting rollers by making a pair of additional rollers contact along the circumferences of the ejecting rollers and clamping and transporting the sheet by the ejecting rollers and the pair of additional rollers, so that the curl of the sheet can be straightened along the circumferences of the ejecting rollers (such as Japanese Patent no. 2547722 and Japan Laid-open publication no. He11-189363).

The temperature of the sheet will rise during heating after passing the fixing device. The temperature of the units constructing the transporting passage or the units arranged on the fringe of the fixing device will tend to rise also. The problems then surface due to the sheet deformation or damage due to the temperature rising and the sheet contamination resulting from the toner supplied onto the surface of the sheet, because the toner is remelted and fallen down. As a result, a sheet with low viscosity is adhered to the transporting unit. When the ambient temperature rises caused by the temperature of the sheet rising after the sheet passed the fixing device, the inner temperature of the other nearby devices arranged near the fixing device such as the cleaning device or the developing device will also rise affectedly. At this time, the collected sheet will possibly be remelted by the cleaning device, and the sheet received inside the developing device will possibly be transmuted.

Additionally, the curling can also be affected by the shape of the transporting passage when passing the fixing device to the curl straightening device due to the heat accumulation when the sheet is heated by the fixing device. For example, in a case when the transporting passage from the fixing device to the curl straightening device is steep and winding, the sheet will easily curl according to the shape of the transporting passage due to the ironing effect from the heat accumulation of the sheet. It can be easily thought as being similar to pressing by the iron to stretch wrinkles.

This kind of transporting passage, which demands more developing units than forming the monochrome images, is widely used to form color images aiming to prevent a large-size structure and to bend the transporting passage to minimize the space in transverse direction or in lengthwise direction. This kind of the transporting passage can also be used to reverse the sheet to form two-face images.

In the conventional structures, in order to get rid of the damages due to the rising temperature, it is proposed to use a transporting belt connected to a portion of the heat pipe to transport the sheet in the transporting passage (such as the Japan Laid-open publication no He11-119489).

The face of a sheet, which supports the toner image, bends towards a side and causes curling resulting form the difference of the humidity between the face of the sheet supporting the toner and the face not supporting the toner. Therefore, the conventional curl straightening structure eliminates the curl by loading in a direction reverse to the direction of the curl to turn the sheet back.

Among the structures that bend the sheet in a direction reverse to the direction of the curl, the ones using a non-moving guide unit to construct a transporting passage cause the tip of the sheet to make contact with the guide unit again after it has been straightened during moving and therefore the tip of the sheet bent reverse to the curl will easily encounter a large resistance during movement. Consequently, failures will occur during transportation.

For solving the problem, the Japanese Patent no. 547722 and the Japan Laid-open publication no. He11-189363 disclose that in the case when transporting rollers are used in the sheet transporting passage to straighten curling, it is necessary to keep the transporting rollers in contact with the ejecting rollers, and it is further necessary to lead the sheet towards the contacting position of the ejecting rollers and the transporting rollers, therefore the structures are complicated. Especially, when the sheet is entering the contacting position on the ejecting rollers and the transporting rollers, the sheet is separated from the transporting guide unit, therefore it is difficult to lead the sheet to the contacting position. Consequently some failures will easily occur during transportation which is similar to the case described above.

The conventional structures for straightening curling using other methods are as follows: one structure is disclosed in the Japan Laid-open publication no. He11-189363, wherein a heat-resistant material is used for constructing the offset preventing layer with fluorine coated onto the surface thereof to form the structure with low heat-conductivity. Therefore, heat from the sheet is easily accumulated. When the sheet is continuously passed through the fixing device, the heat accumulated will increase on the rollers at the side in contact with the toner. In other words, the surface temperature of the roller will rise and the rollers will serve to heat up other rollers in contact thereon.

Under this condition, the sheet will pass through the fixing device and will be heated by the opposite rollers in contact thereon. Then the sheet will deteriorate and the toner on the fixed sheet may remelt due to the rising temperature and cause offset.

However, in the structure described in the publications above, if the structures of curl straightening and cooling are separately constructed to form the structure with individual functions, it may cause the structure to be a large-size or may increase the cost.

SUMMARY OF THE INVENTION

For solving the problems of the conventional ejecting structures, the present invention proposes an ejecting device and an image forming apparatus to prevent the structures from being large in size, to prevent the parts from deteriorating due to heat, to efficiently straighten the curl, and to restrict the temperature rising in the curl straightening unit to restrict offset.

For solving the problems of the conventional sheet transporting device, especially for the problems related to the curl straightening of the sheet, the present invention propose a curl eliminating device of the sheet and an image forming apparatus to cool and straighten curling of the sheet at the same time without increasing the cost.

The present invention proposes a sheet ejecting device using a heat member and a press member arranged opposite to each other within a transporting passage of a sheet which supports a toner image to fix the sheet by heating and pressing and afterwards ejecting the fixed sheet. The sheet ejecting device further comprises a de-curl mechanism, including: a first roller positioned at a side facing and contacting the toner image supported by the sheet; a plurality of second rollers arranged abreast on a circumference of the first roller and contacting the circumference of the first roller. The second rollers clamp and transport the sheet to allow the sheet to conform with the circumference of the first roller. The de-curl mechanism bends the sheet reverse to a curl-generating direction of the sheet to straighten a curl. One of the rollers constructing the de-curl mechanism is made of a cooling member.

In the present invention, the cooling member is used to the first roller positioned at the side facing and contacting the toner image.

In the present invention, the cooling member is a roller bending the sheet reverse to the curl-generating direction.

In the present invention, the cooling member is made by a heat pipe.

In the present invention, a material, serving as a base of the heat pipe, is used directly in contact with the sheet to cool the sheet.

In the present invention, the heat pipe comprises a radiating fan arranged on an end of an axial direction of the heat pipe, and the radiating fan is cooled by a cooling fan arranged near the radiating fan.

In the present invention, the cooling fan is capable of controlling an airflow according to a temperature of the heat pipe.

In the present invention, the radiating fan of the heat pipe is connected to a sheet dehumidifying unit.

In the present invention, a tension of the sheet, passing the de-curl mechanism, is changed at an entrance side and an exit side of the de-curl mechanism.

In the present invention, the tension of the sheet is larger at the exit side of the de-curl mechanism than that at the entrance side.

In the present invention, among the second rollers, a rotating speed of the second roller positioned at a downstream side in an ejecting direction of the sheet is larger than that of the second roller positioned at an upstream side.

In the present invention, among the second rollers, an outer diameter of the second roller positioned at the downstream side in the ejecting direction is large than that of the second roller positioned at the upstream side.

The present invention further proposes an image forming apparatus comprising one of the sheet ejecting devices described above.

In the present invention, the de-curl mechanism is arranged before the sheet, transported after being fixed, is led into a sheet reversing passage.

The present invention proposes a curl eliminating device, comprising: a transporting roller, arranged in a sheet transporting passage; and a plurality of backup rollers, arranged abreast along a circumference of the transporting roller. The backup rollers press-contact the transporting roller during rotating. The curl eliminating device clamps and transports the sheet in a way that the sheet conforms with the shape of the circumference of the transporting roller. The backup rollers are separately arranged along the circumference of the transporting roller, and a separating distance is set to be changeable. The separating distance is set according to the amount of curling of the sheet.

In the present invention, the backup roller further comprises a plurality of roller units subdivided in axial direction of the backup rollers. The roller units are arranged in the axial direction with position-shift and an operation timing of each backup roller can be changed.

In the present invention, the transporting roller is used to as a sheet cooling member, and the friction between the transporting roller and the sheet is set smaller than that between the backup rollers and the sheet.

In the present invention, relative circumferential-speeds of the transporting roller and the backup rollers can be changed.

The present invention further proposes an image forming apparatus, comprising one of the curl eliminating devices described above, and with using the curl eliminating device, the transporting roller can cool the sheet.

The present invention further proposes an image forming apparatus, comprising: a fixing device using a heat member and a press member arranged opposite to each other within a transporting passage of a sheet which supports a toner image to fix the sheet by heating and pressing and then ejecting the fixed sheet; a reversing device for reversing and transporting the sheet ejected from the fixing device; a transporting roller, having a promptly cooling structure to construct a cooling member to cool the sheet during transporting, is arranged in the transporting passage, going towards the reversing device from the fixing device; and a plurality of backup rollers arranged abreast on a circumference of the transporting roller for clamping and transporting the sheet in a way that the sheet imitating a shape of the circumference of the transporting roller. The transporting roller and the backup roller are arranged in a way that can bend the sheet oppositely to a curl-generating direction of the sheet, when it is ejected from the fixing unit, and then to move the sheet toward the reversing device.

BRIEF DESCRIPTION OF THE DRAWINGS

While the specification concludes with claims particularly pointing out and distinctly claiming the subject matter which is regarded as the invention, the objects and features of the invention and further objects, features and advantages thereof will be better understood from the following description taken in connection with the accompanying drawings in which:

FIGS. 6A and 6B show the structures of the de-curl mechanisms, wherein FIG. 6A is a side view and FIG. 6B shows changing the separating distance between the backup rollers of FIG. 6A;

FIGS. 8A and 8B show the separating distance between the backup rollers of FIG. 6A, wherein FIG. 8A shows the condition that the separating distance is narrow and FIG. 8B shows the condition that the separating distance is wide.

DESCRIPTION OF THE PREFERRED EMBODIMENT

The embodiments according to the present invention will be explained with the drawings as follows.

Figure 1:
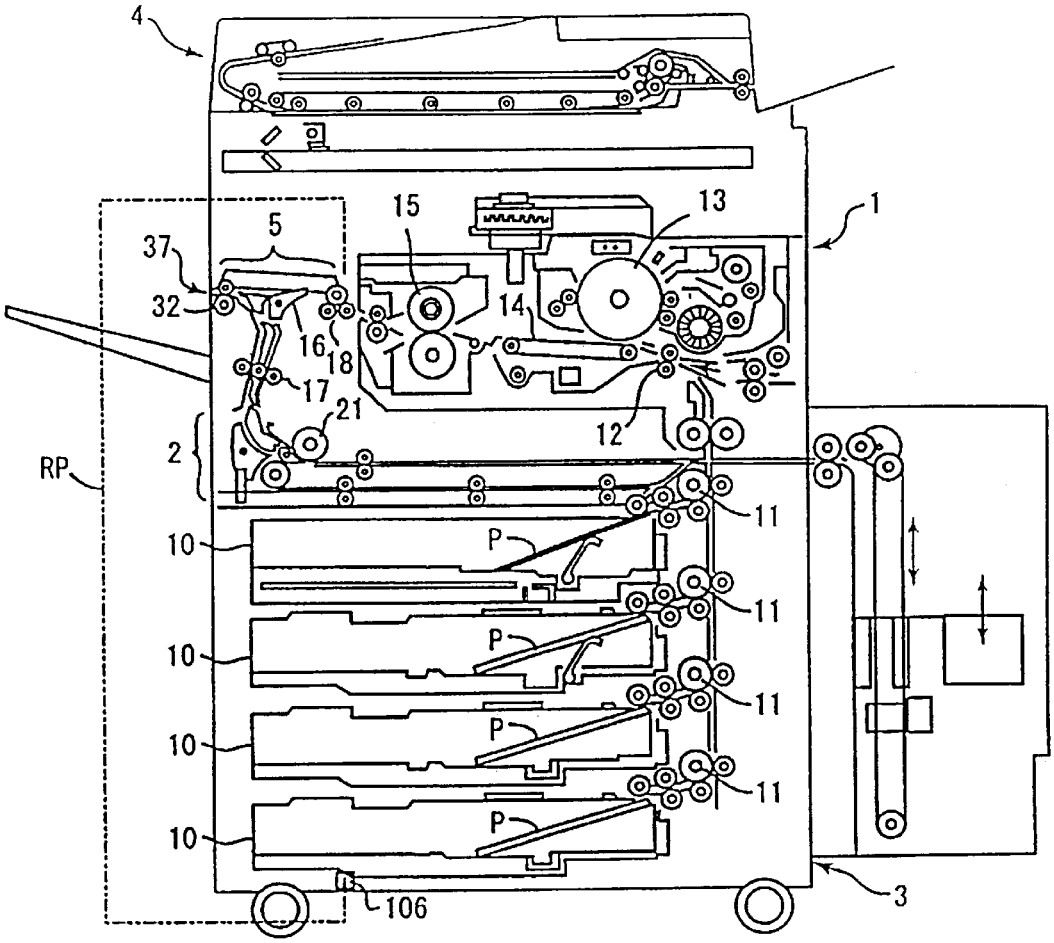
FIG. 1 shows an image forming apparatus, in which a fixing device is used, according to one embodiment of the present invention.

FIG. 1 shows an image forming apparatus using a curl eliminating device according to one embodiment of the present invention.

The image forming apparatus is a copy machine shown in the same figure. However, the image forming apparatus of the present invention is not limited to the copy machine. The image forming apparatus of the present invention includes not only a printer or a facsimile machine but also a multi-color image forming apparatus, which uses the structure having the visualization-treatment units, the medium transcriber and the two-time transcribing device or the structure superimposing and transcribing the images of the sheet in different colors during transporting the sheet to form full color images. The copy machine forms the electrostatic latent image based on the monochrome image information obtained by scanning the document onto the photosensor and performs visualization-treatment of the electrostatic latent image. The printer is one of the output devices of the host computer. The facsimile machine can form the electrostatic latent image according to the electrical transmission image information by optic-writing. The medium transcriber can one-time transcribe the visualization-treatment image according to the colors and superimpose the images in different colors. The two-time transcribing device can collectively transcribe the transcribed and superimposed images onto the sheet.

The copy machine, shown in FIG. 1, comprises a feeding device 3, an image forming apparatus 1, and an automatic document feeding exposure device 4. The feeding device 3 is constructed by four feeding trays 10 capable of receiving the transcribing paper such as the sheet, and respective feeding rollers 11. The image forming apparatus 1 is arranged on the upper side of the feeding device 3. The automatic document feeding exposure device 4 is arranged on the upper side of the image forming apparatus 1 for obtaining image information from the document.

The transcribing unit 14 is arranged in the image forming apparatus 1 in a way capable of being in contact with the photosensor drum 13. The resist rollers 12, which get the transcribing timing of the sheet, are set on the upstream side of the sheet transporting direction with respect to the photosensor drum 13. The fixing unit 15, which heats and fixes the transcribed sheet, is set on the downstream side of the sheet transporting direction.

The fixing method used in the fixing unit 15 of the present invention for heating roller involves combining the heat rollers and the pressure rollers, is. The heat rollers are positioned at the side of the toner supporting face of the sheet. The pressure rollers are opposite to the heat rollers and put pressure on the heat rollers during transporting.

The sheet ejecting exit 37 where the ejecting device 32 is disposed is set on the extending path of the transporting passage of the sheet ejected from the fixing unit 15. The ejecting device 32 comprises rotatable ejecting rollers 32A, 32B (referring to FIG. 2), which clamp and contact the transporting passage with the ejecting reversing unit 5.

Figure 2:
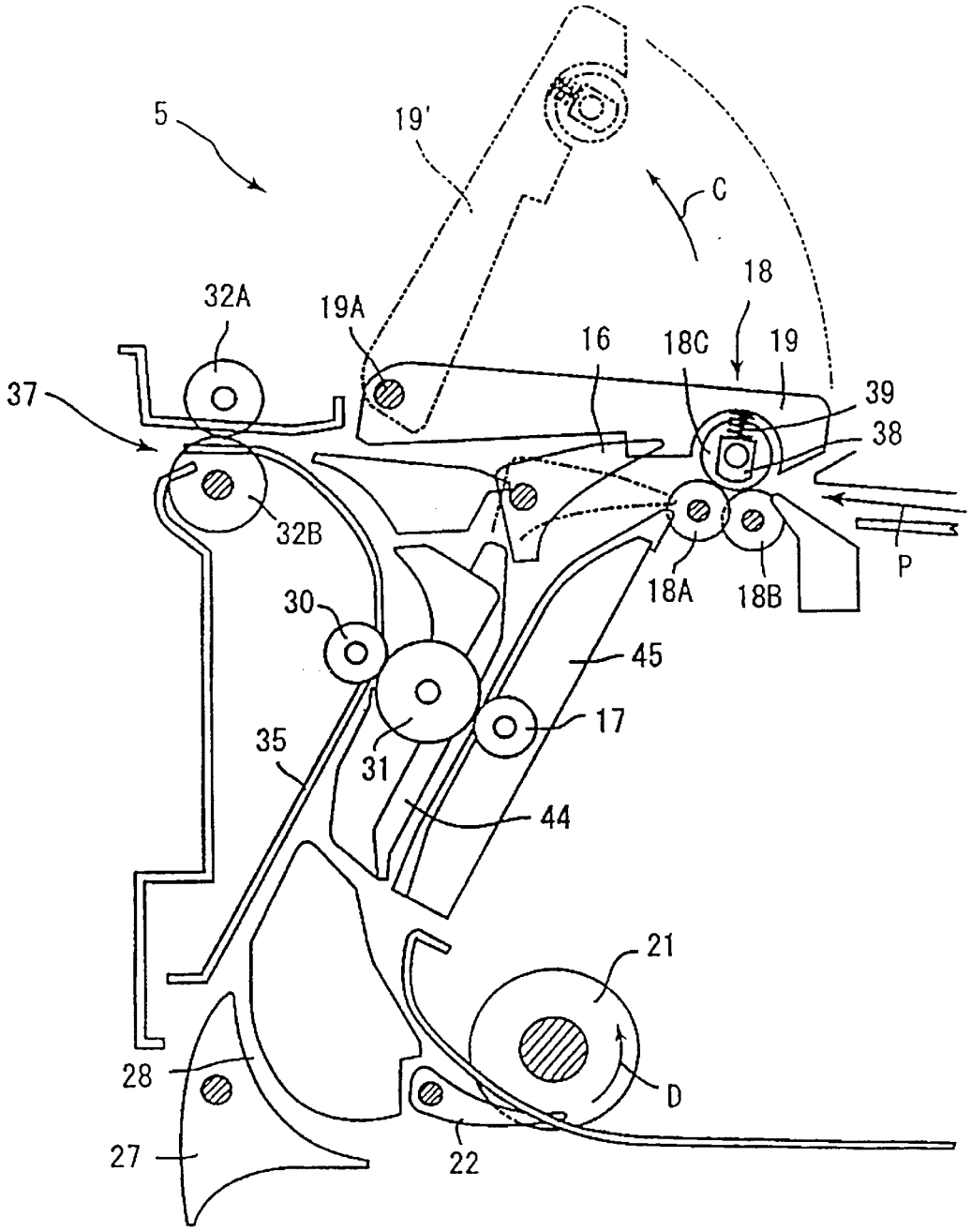
FIG. 2 shows the ejecting reversing unit set on the imagine forming apparatus of FIG. 1.

The structure of the ejecting reversing unit 5 is shown in FIG. 2. In the ejecting reversing unit 5, shown in FIG. 2, the backup rollers 18A, 18B and transporting rollers 18C, which construct the de-curl mechanism 18 to eliminate the curl of the sheet as described in detail latter, and the reversing switch claws 16 are respectively arranged on the upstream side extending along the ejecting direction of the sheet P from the fixing unit 15. The reversing switch claws 16 are able to swing and can switch the sheet passing through the de-curl mechanism 18 toward one of the reversing passages having a sheet ejecting exit 37 or having guide plates 35, 44, and 45.

If the reversing passage is selected to be the passage when the image is formed toward two faces of the sheet or when the sheet is ejected under reversing, once the sheet is led into the transporting passage constructed by the guide plates 44, 45 and after the sheet is switched back in the reversing unit described latter (the numeral reference 2 in FIG. 1), the condition of re-feeding the sheet or the condition of transporting the sheet toward the sheet ejecting exit 37 can be selected. Then, the inner ejecting rollers 17 and the outer ejecting rollers 30, which can transport the sheet according a predetermined direction, and the interlocking rollers 31, which contacts the inner ejecting rollers 17 and the outer ejecting rollers 30 and can move together with them, are respectively arranged at the pre-determined positions on the transporting passage constructed by the guide plates 44, 45 at the side of leading the sheet and on the transporting passage constructed by the guide plates 35, 44.

The reversing rollers 21, the branch claws 22 and the two-face branch claws 27 are respectively set in the reversing passage shown in FIG. 2. The reversing roller 21 switches back the sheet into the transporting passage, which is rotated to the direction of the alphabet D and constructed by the guide plates 44, 45. The two-face branch claws 27 can set the passage for re-feeding the switched back sheet, and can set the ejecting reversing passage 28 for which the switched back sheet is transported toward the sheet ejecting exit 37.

Figure 3:
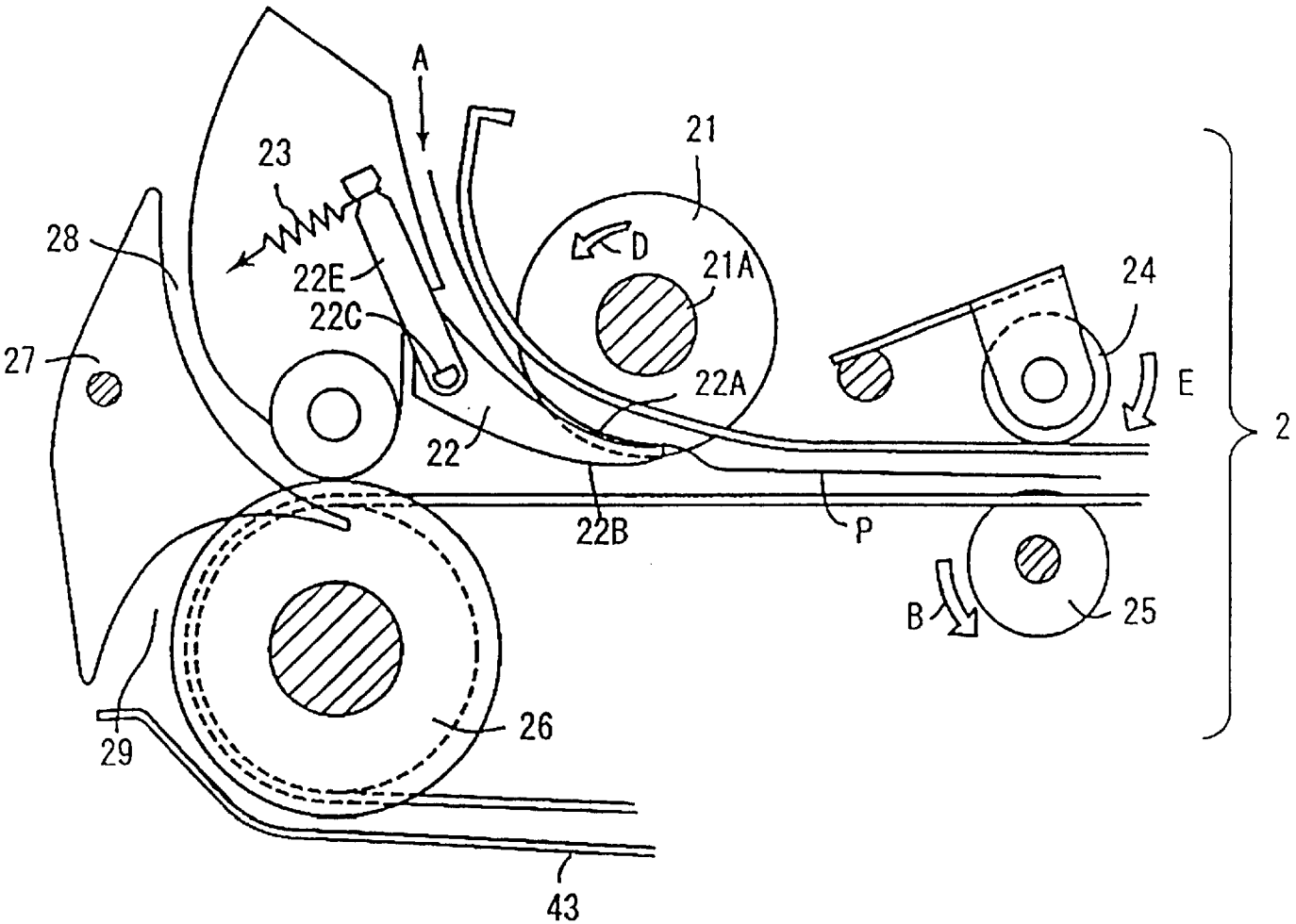
FIG. 3 shows the reversing unit used on the ejecting reversing unit of FIG. 2.
Figure 4:
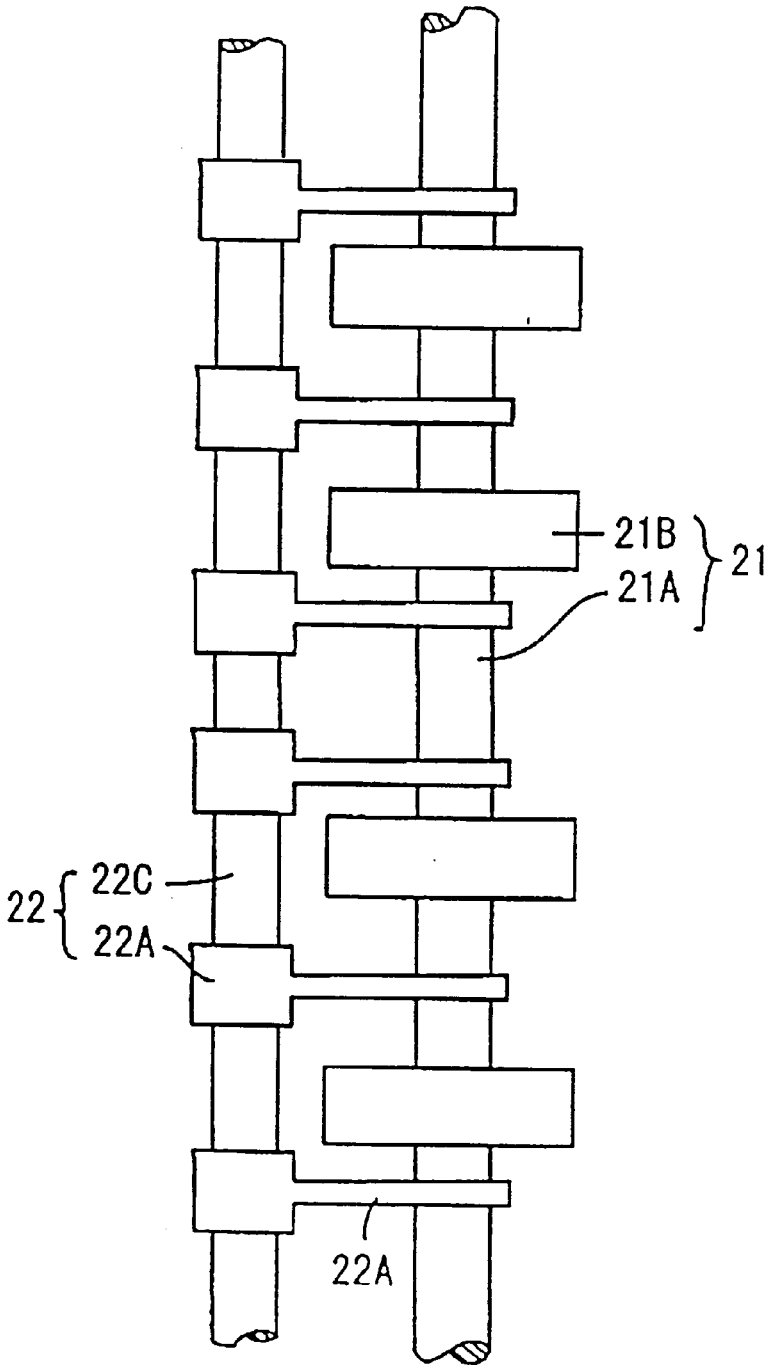
FIG. 4 is a plan view showing the parts used on the reversing unit of FIG. 3.

The reversing unit 2 has the structure shown in FIG. 3. In the reversing unit 2 as shown in FIG. 3, the branch claws 22 are set overlapping on the reversing rollers 21, which always rotates along the D direction of the sheet transporting. In the reversing rollers 21 as shown in FIG. 4, the roller units 21B are separately arranged on the shaft 21A at about an even distance. In the branch claws 22, the claws 22A are separately arranged on the shaft 22C at about an even distance. The claws 22A of the branch claws 22 as shown in FIG. 3 are pivotally supported on the device body by the shaft 22C in a way capable of swinging. The claws 22A of the branch claws 22 will swing into the shaft 21A of the reversing rollers 21.

The actuating member 22E is fixed at a pre-determined position on the shaft 22C of the branch claws 22. The tip end of the actuating member 22E is installed on one end of the spring, wherein the other end of the spring is fixed on the device body The claws 22A of the branch claws 22 are actuated toward the direction of the shaft 21A of the reversing rollers 21.

The switchback driven rollers 24 and the switchback rollers 25 are set on the rear side of the reversing rollers 21 in the sheet transporting direction generated by the rotation of the reversing rollers 21. The two-face roller 26 and the lower guide plate 43, which construct a portion of the transporting passage when performing two-face printing, are set on the front of the reversing rollers 21 in the sheet transporting direction.

The two-face branch claws 27 is arranged near the two-face roller 26, and the ejecting reversing passage 28 or the two-face re-feeding passage 29 is formed on the two-face roller 26 by switching the two-face branch claws 27.

Figure 5:
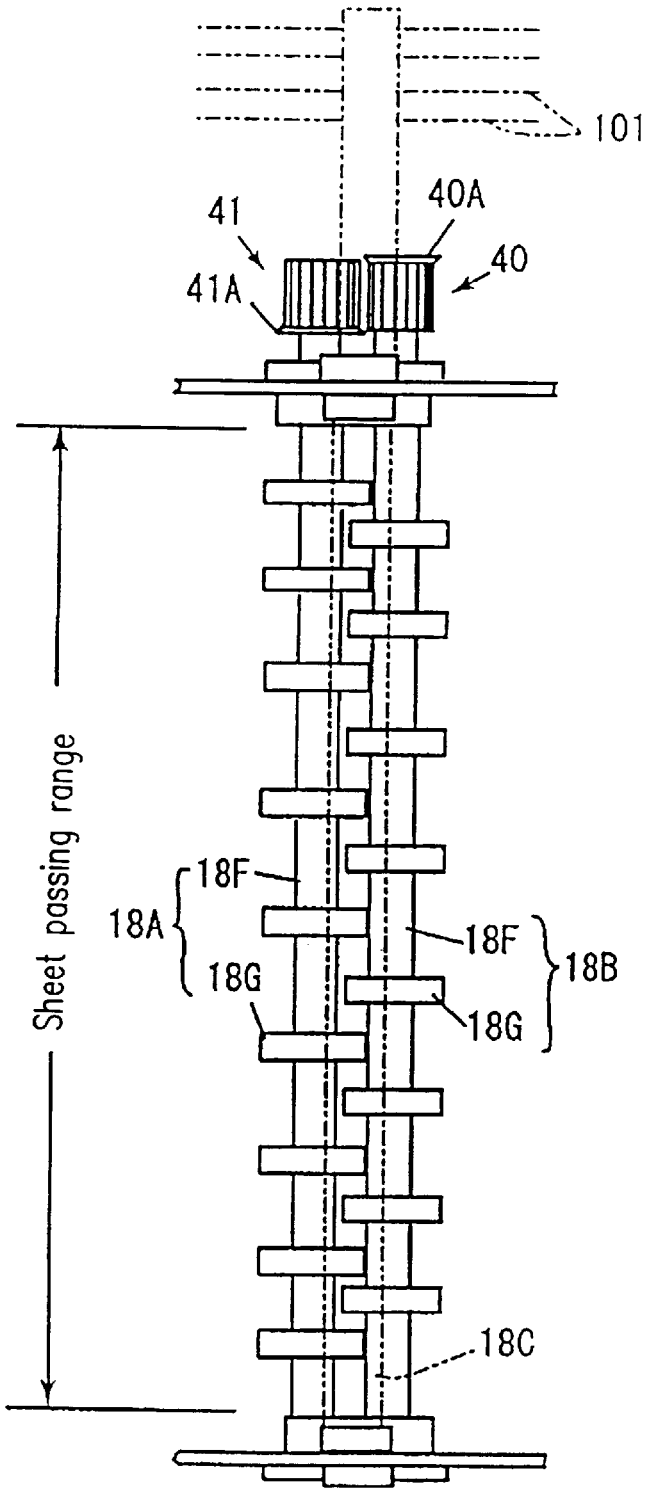
FIG. 5 is a plan view showing the structures of the ejecting device according to one embodiment of the present invention.

FIGS. 2, 5 to 7 show the structure of the de-curl mechanism 18 disposed at a position where the sheet being ejected out of the fixing unit 15 arrives. FIG. 5 is a plan view showing the de-curl mechanism 18 from the transporting rollers 18.

The de-curl mechanism 18, shown in FIG. 2, has the backup rollers 18A, 18B oppositely arranged to clamp the sheet transporting passage, and the transporting roller 18C. The backup rollers 18A, 18B are arranged abreast along the circumference direction of the transporting roller 18C and are in contact with the circumference of the transporting roller 18C.

The backup rollers 18A, 18B, shown in FIG. 2, serve as backings with respect to the transporting roller 18 when the transporting roller 18C is in contact with the sheet. Referring to FIG. 5, the backup rollers 18A, 18B are constructed by the shafts 18F and the roller units 18G. The axial direction of the shafts 18F is parallel to the width direction of the sheet, which is perpendicular to the sheet transporting direction. The roller units 18G are arranged on the shafts 18F. The roller units 18G arranged on one shaft 18F are fixed or integrally formed along the axial direction of the shaft 18F with phase-shift with respect to that arranged on the other shaft 18F.

The separating space between the roller units 18G on one shaft 18F is inserted by the roller units 18G positioned at the side of the other shaft 18F near the circumference of the shaft 18F.

Because the roller units 18G of the backup rollers 18A, 18B, excluding the shafts 18F, are made of material with a relatively low thermal conductivity (the gum such as EP gum, urethane and silicon gum or the resin such as polyacetal, polyethylene terephthalate and polycarbonate), the backup rollers 18A, 18B can be prevented from obtaining abnormal high temperature at the surface thereof.

Referring to FIG. 5, the backup rollers 18A, 18B are driven to rotate through the timing belt (not shown) engaged by the pulleys 40A, 41A of the drivers 40, 41, and the timing belt is engaged and rotated by the driving source not shown.

The pulleys 40A, 41A are installed on the shafts 18F. The drivers 40, 41 are set at one end of the shafts 18F in the axial direction.

Figure 6A:
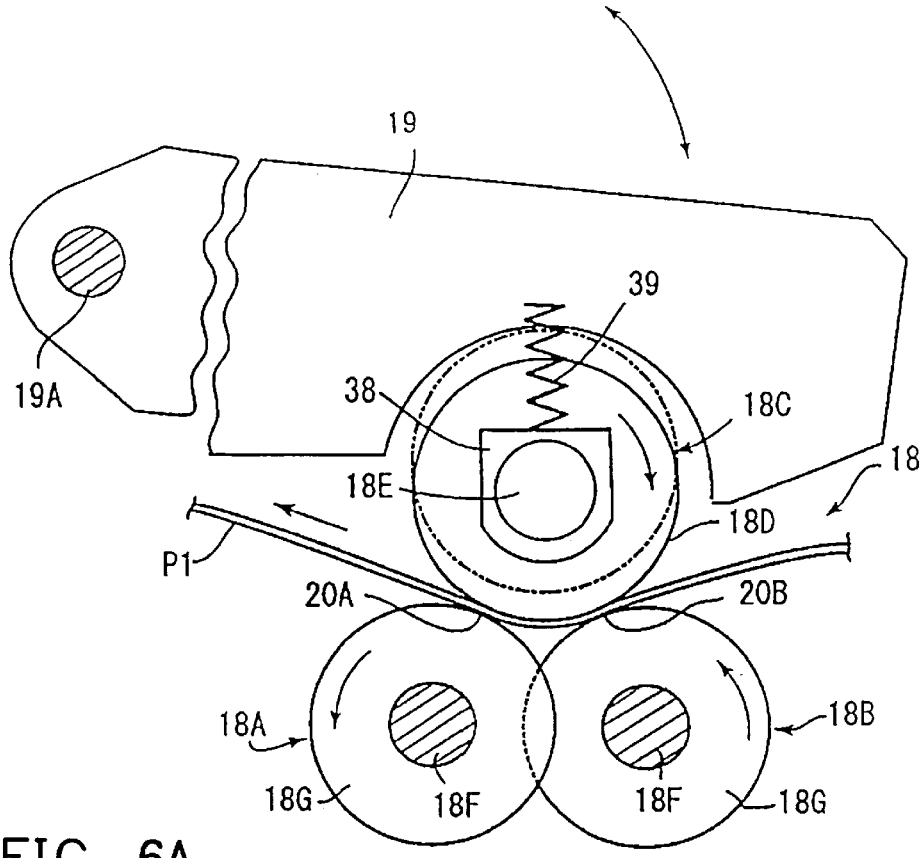
Figure 6B:
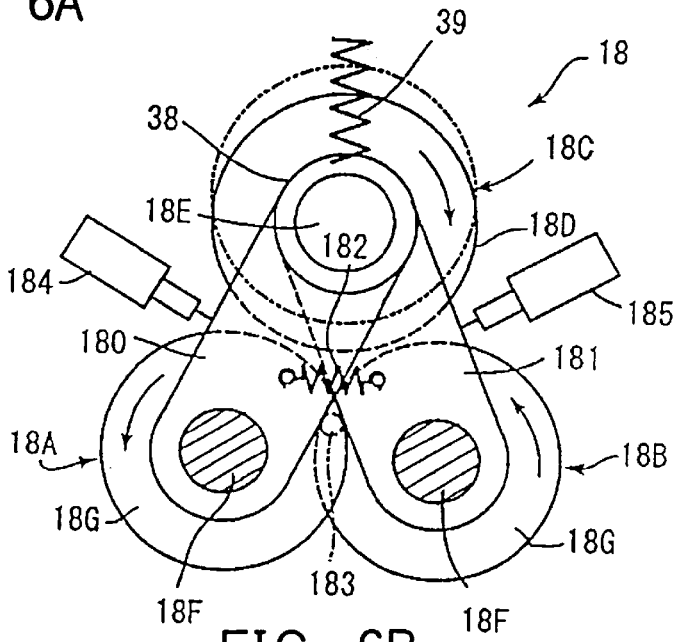

Referring to FIGS. 6A, 6B, the transporting roller 18C serves as the cooling member of the de-curl mechanism 18. The surface of the heat pipe 18D, whose base is made of metal pipe capable of making direct contact with the toner image supported by the sheet, is used to the transporting roller 18C.

The interior of the heat pipe 18D is sealed with the heat medium. Then the heat can be transferred because the steam of the heat medium generated at a high temperature unit will move quickly to the low temperature unit and will be condensed instantly. The nickel-plated metal pipe can be used as the heat pipe 18D, and the pure water with 20% floor area ratio can be used as the heat medium.

Figure 7:
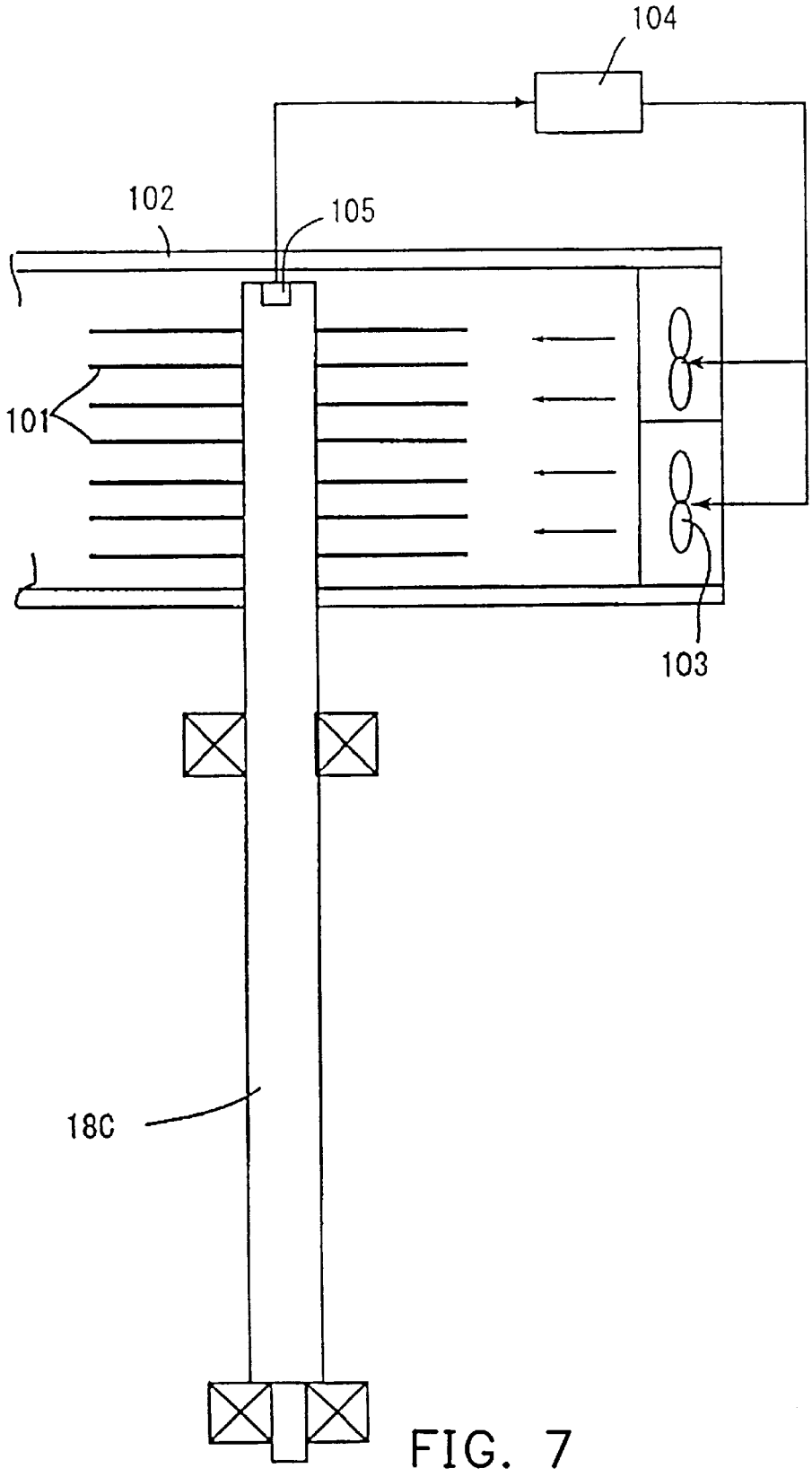
FIG. 7 is a plan view showing the cooling parts used on the de-curl mechanism.

In this embodiment, referring to FIGS. 5 and 7, the radiating fan 101 made of good thermal conductors is integrally formed at one end of the axial direction of the transporting roller 18C, wherein the end is positioned outer than a range that the sheet passes. The radiating fan 101, shown in FIG. 7, is located in the radiating chamber 102 installed on the inner wall of the image forming apparatus 1 that forms the supporting unit of the de-curl mechanism 18.

The cooling fan 103 is set in the radiating chamber 102 to force the radiating fan 101 to cool.

In this embodiment, the airflow of the cooling fan 103 is set according to the surface temperature of the transporting roller 18C using the heat pipe. Then, as shown in FIG. 7, the cooling fan 103 is connected to the output side of the controller 104, of which the input side is connected to the temperature sensor 105 sensing the surface temperature of the transporting roller 18C. Therefore, with the output signals from the controller 104, the cooling fan 103 can rotate and be controlled.

In the aspect of saving the electricity cost, it is optimum to start rotating the cooling fan 103 when the surface temperature of the transporting roller 18C arrives and rises above a pre-determined temperature. In the present embodiment, the heat radiated from the transporting roller 18C is transported to other portion by the airflow of the cooling fan 103.

The heat dissipating duct etc., is used at the opposite side (shown as the two-dot chain line RP in FIG. 1) of the cooling fan 103 in the radiating chamber 102, shown in FIG. 7, to connect the flowing out unit 106 positioned under the bottommost feeding tray 10 of the feeding device 3. In this way, the hot air dissipates from the radiating fan 101, the dissipating heat is led from the flowing out unit 106 serving to dehumidify into the feeding bank where the feeding tray is received. Thus, the sheet received in the feeding tray 10 can be dehumidified.

The amount of curling is different when the sheet is heated under different humidity conditions. The curl bending toward the toner image supporting face occurs easily. If the water contained sheet can be dried without extreme difference in the humidity, the curl can be easily restricted.

Because the flowing out unit 106, shown in FIG. 1, is beneath the bottommost feeding tray 10, the hot air will become an ascending flow. Then, with the ascending flow, the hot air can be passed to each feeding tray 10.

The structure, for eliminating the jam and taking out the jammed sheet, is set on the de-curl mechanism 18. An upper guide member 19 capable of swinging pivotally on the shaft numbered 19A shown in FIG. 2, is used in the above structure. The transporting roller 18C is supported on the side of the swinging end of the upper guide member 19.

The rotating shaft 18E of the transporting roller 18C set on the upper guide member 19, shown in FIGS. 6A, 6B, is inserted into the bearing 38. The bearing 38 is supported by the spring 39 in a floating condition, with respect to the upper guide member 19. With the structure, the bearing 38 forms the nip portions 20A, 20B on the positions in contact with each roller under the condition of good contact with the backup rollers 18A, 18B and the transporting roller 18C. Furthermore, the bearing 38 can move up and down due to the flexural rigidity, varying with the thickness of the sheet passing the de-curl mechanism 18, the sheet's strength. Then the careless press force from the side of the transporting roller 18C will not be increased onto the sheet during moving.

The backup rollers 18A, 18B, in opposite contact with each other through the transporting roller 18C, are different in rotating speed within the de-curl mechanism 18. In this embodiment, referring to FIGS. 6A, 6B, in the backup rollers 18A, 18B opposite to the transporting roller 18C, the outer diameter of the backup roller 18A positioned at the downstream side in the ejecting direction (the arrow direction shown in FIG. 4) is bigger than that of the backup roller 18B positioned at the upstream side. In this way, the circumferential-speed of the backup roller 18A can be increased.

With the structure, the tension force of the sheet passing the de-curl mechanism 18 at the exit side increases more than that at the entrance side. Then, with being hauled to the backup roller 18A, the sheet passing the de-curl mechanism 18 can easily displace toward the transporting roller 18C, and the contacting pressure against the transporting roller 18C is increased.

The separating distance between the backup rollers 18A, 18B, set on the de-curl mechanism 18, on the circumference direction of the transporting roller 18C can be changed.

FIGS. 6A, 6B show two examples of changing the separating distance between the backup rollers 18A, 18B. The backup rollers 18A, 18B are set on the swinging ends of the supporting arms 180, 181 capable of swinging. The base ends of the supporting arms 180, 181 are supported on the rotating shaft 18E of the transporting roller 18C. Under this condition, the base ends of the supporting arms 180, 181 are inserted and supported in a way capable of swinging with respect to the rotating shaft 18E.

The supporting arms 180, 181 are granted the habit of closing to each other by the coil springs (such as the elastomers 182), whose ends are respectively hanged on the positions opposite to the halfway from the base end to the swinging end of the supporting arms 180, 181. The approach limiting position abuts the fixing unit 183 to restrict the supporting arms 180, 181.

The approach limiting position is a position where the backup rollers 18A, 18B are closest to each other and the separating distance between the backup rollers 18A, 18B is smallest.

The actuators of the solenoids 184, 185 are respectively hanged opposite to the latching and holding position of the elastomer 182 of the supporting arms 180, 181. Then, with the motion of the solenoid 184, the supporting arms 180, 181 can swing toward separating from each other.

Figure 8A:
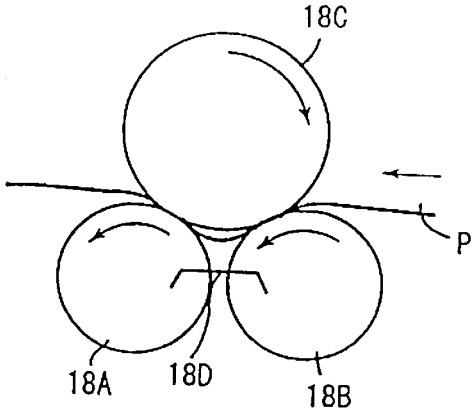
Figure 8B:
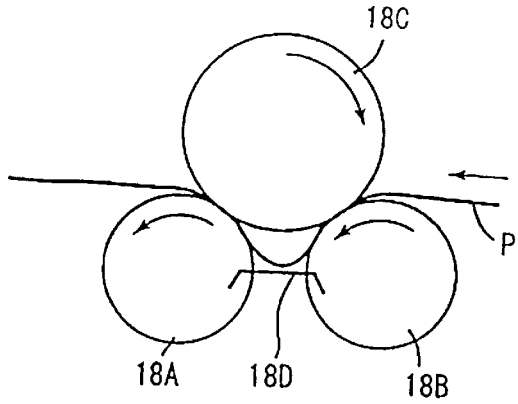

FIGS. 8A and 8B show that the separating distance between the backup rollers 18A, 18B is changed according to the amount of swinging of the supporting arms 180, 181, wherein FIG. 8A shows an initial condition that the backup rollers 18A, 18B are closest to each other and FIG. 8B shows the condition of increasing the separating distance from the initial condition.

The separating distance is changed by a magnetization control of the solenoids 184, 185. The sheet under the condition shown in FIG. 8B is set to be more loose than that under the condition shown in FIG. 8A.

When the sheet is loose, the curvature of the sheet can be changed when the sheet moves along the circumference of the transporting roller 18C. Then, under the condition shown in FIG. 8A, the curvature become small and under the condition shown in FIG. 8B, the curvature become large. Therefore, when the curvature of the sheet becomes larger, the effect of curl-straightening is relatively high with respect to the sheet moving along the circumference direction of the transporting roller 18C, equaling to the reversing direction of the curl generating direction. Furthermore, the guide plate 18 in FIGS. 8A, 8B prevents the sheet from separating when the separating distance become larger.

Figure 9:
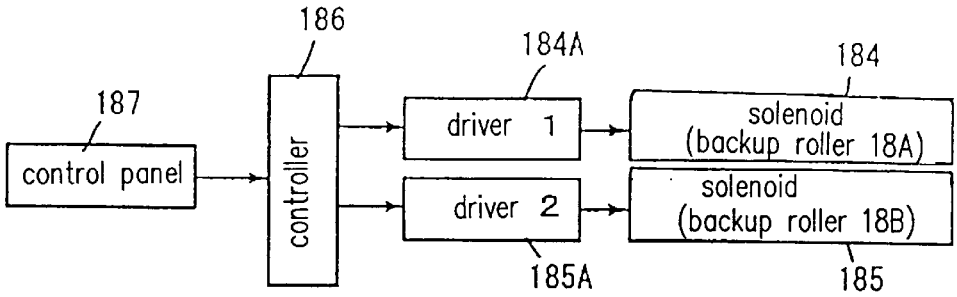
FIG. 9 is a blocking diagram showing the driving controller of FIG. 6B.

The controller shown in FIG. 9 is applied to the structure to change the separating distance between the backup rollers 18A, 18B.

FIG. 9 is a blocking diagram showing the controller driving and controlling the solenoids 184, 185 shown in FIG. 6B. The input side of the controllers 186 is connected to the control panel 187 through the I/O interface (not shown), and the output of the controllers 186 is connected to the drivers 184A, 185A of the solenoids 184, 185.

The direct number inputting switch or the sheet selecting switch is set on the control panel 187. The direct number inputting switch can take the adjustment amount of the curl by the user by directly inputting numbers. The sheet selecting switch can automatic set the adjustment amount according to the sheet selected by experimenting on the relationship between the fixing temperature and the curl varying with the sheet types. In this embodiment, because the solenoid which is the member capable of controlling two positions is applied, the amount of curl adjustment can be selected to be normal and more than the normal. Additionally, for different sheet types, the flexural rigidity affecting the curl can be sorted into thick paper and thin paper etc.

In the controller 186, the signals, which set the separating distance between the backup rollers, having an amount of looseness according to the input curl adjustment amount, are outputted to the drivers 184A, 185A of the solenoids 184, 185. Especially, when the curl adjustment amount is large, the separating distance for the magnetization of the solenoids 184, 185 is large.

The solenoids for changing the separating distance between the backup rollers 18A, 18B can be replaced by a pulse motor set having sector gears and driving gears engaged with the sector gears. The sector gears are formed on the base end of the supporting arms 180, 181. With the structure, the separating distance can be changed according to the engagement position of the gears. In other words, the separating distance can be changed to sections, and then the curl adjustment amount can be a wide range. Thus, the structure is suitable for various types of sheet.

With the structure described above in this present embodiment, the sheet transcribed by the image forming apparatus 1 is heated and fixed by the fixing unit 15 and then is ejected from the fixing unit 15.

With the structure described above in this present embodiment, the sheet ejected from the fixing unit 15 will arrive the de-curl mechanism 18.

In the de-curl mechanism 18, the transporting roller 18C are constructed by the heat pipe 18D with good thermal conductor. The surface of the transporting roller 18C is used to cool the sheet. In the de-curl mechanism 18, the transporting roller 18C is positioned at one side capable of bending and straightening the sheet reverse to the direction of curl generated at the side contacting the toner image supported by the sheet. Thus, the sheet, which has arrived the de-curl mechanism 18, will be in contact with the transporting roller 18C, and the transporting roller 18C will cool the sheet to increase the rigidity of the sheet, and then the sheet will recover to its original rigidity.

The heat medium evaporates and liquefies repeatedly in the transporting roller 18C. Because the radiating fan 101 on the transporting roller 18C is cooled by the cooling fan 103, the thermal circulation can be performed instantly. Thus, the temperature of the sheet that is in contact with the transporting roller 18C and the toner image will start dropping temperature when the sheet is in contact with the transporting roller 18C.

The inventors of the present invention experimented with the temperature drop of the sheet by making them in contact with the transporting roller 18C and the result is as follows.

The surface temperature of the sheet is 100 degrees immediately after the sheet passes the fixing unit 15. Then, when the surface temperature of the transporting roller 18C is 70° C., the surface temperature of the sheet is dropped to about 77~78° C.

It is preferred that the dropping temperature will not obstruct the soft toner performing osmosis to the sheet. Especially, when fixing multi-color images with more toner layers than the monochrome image, more heat is needed. Then the sheet ejected from the fixing unit 15 is accumulated with large heat. The radiating heat in the transporting roller 18C can be adjusted suitably by the airflow controlling of the cooling fan 103. With the suitable radiating heat, the dropping temperature described above can be set. Thus, the flexural rigidity of the hanging down sheet, which is soft due to heat accumulation, will be recovered because of the temperature drop. The temperature can also be maintained without obstructing the osmosis of the toner, i.e., the fixing. Therefore, the hot offset, which easily happens above this temperature, can be prevented.

In this embodiment, the transporting roller 18C can efficiently take the heat of the sheet because the surface of the transporting roller 18C is directly in contact with the sheet. Unlike the condition of the surface being coated, the surface of the transporting roller is naked to instantly cool off the sheet. In this way, the heat offset can be prevented and it is no longer need to set the offset preventing layer.

The sheet passing the de-curl mechanism 18 is hauled during transportation due to the tension being increased more at the exit side than at the entrance side, result from that the circumferential-speed of the backup roller 18A positioned at the downstream side in the ejecting direction is faster than that of the backup roller 18B positioned at the upstream side. When the sheet is hauled by the downstream side in the ejecting direction, the sheet is tightly stretched toward the transporting roller 18C, the sheet is easily in contact with the transporting roller 18C. With the structure, the sheet can efficiently receive the cooling effect from the transporting roller 18C and the temperature can be instantly decreased. Therefore, recovering the flexural rigidity of the sheet and preventing the hot offset of the toner can be performed at the same time.

In this embodiment, because the sheet passes the de-curl mechanism 18 before the sheet arrives the reversing transporting passage, the flexural rigidity of the sheet can be recovered to resist against the habit of bending caused by the reversing transporting passage when the sheet moves toward the reversing transporting passage. In this way, when the sheet passes the reversing transporting passage, the careless re-curl can be prevented.

In the case when the transporting roller 18C, which is in contact with the backup rollers 18A, 18B in the de-curl mechanism 18, is used to cool the sheet, the transporting roller 18C can also contribute cooling of the backup rollers 18A, 18B. As a result, the deterioration of the backup rollers 18A, 18B can be prevented.

In this embodiment, the simple structure, in which only the tension of the sheet itself is set, is used to improve the condition of being in contact with the transporting roller 18C. Therefore, the cooling effects are good without a special pressing unit or a pressure unit.

In this embodiment, the sheet can be prevented from the habit of easily bending if the sheet ejecting passage is tortuous, which is widely used when the positions of the fixing unit 15 and the sheet ejecting exit 37 differ in up-down direction, by recovering the flexural rigidity of the sheet due to cooling. In other words, although, the developing treating unit or the transcribing units are needed in the structure forming the multi-color images to form images, it is generally not favorable to make the height of the device itself be large. Therefore, if the sheet transporting passage is required to save space in the transverse direction, it is set at the position with shift described above in longitudinal direction. Then the sheet transporting passage points toward the upper side of the sheet ejected from the fixing unit 15, and the sheet may have the habit of bending in the point portion. Here, in this embodiment, the sheet passed the point portion is forced to cool then the original flexural rigidity of the sheet can be recovered to eliminate the curl.

In case when the separating distance between the backup rollers changes in accordance with the rigidity increasing due to cooling the curl, the amount of looseness of the sheet is changed. Then with the changeable curvature in the loose portion, the curl can be straightened. When a large curl adjustment amount is input to the control panel 187 (referring to FIG. 9), the solenoids 184, 185 is magnetized and then the supporting arms 180, 181 swing from the initial condition to separate each other, and then the separating distance between the backup rollers 18A, 18B will be expanded. When the sheet passes through the separating space between the backup rollers 18A, 18B, the curvature is changed by the amount of looseness of the sheet according to the curl amount. The habit of reversing to the curl generating direction under the large curvature condition is stronger than that under the small curvature condition, and the effect of curl-straightening is also improved.

The other embodiments related to the present invention are explained as follows.

In the other embodiment, different from the conditions shown in FIGS. 8A, 8B, the amount of looseness of the sheet is changed without changing the separating distance between the backup rollers. The feature of the embodiment is that the operation timings of the backup rollers differ from each other.

In this embodiment, in the structure of the drivers 40, 41 shown in FIG. 5, the individual driving source is used to each backup roller 18A, 18B. Referring to FIG. 5, the timing belt (not shown) of each backup roller 18A, 18B is driven by individual driving source. The timing belt is engaged and rotated by the pulleys 40A, 41A set on the shafts 18F of the backup rollers 18A, 18B.

According to this embodiment, regarding to the frictions of the backup rollers 18A, 18B and the transporting roller 18C, the friction between the sheet and the transporting roller 18C is smaller than that between the backup rollers 18A and 18B. In this way, the sheet is affected by the rotation of the transporting roller 18A, and can be moved by the rotational force generated by the backup rollers 18A, 18B.

FIG. 9 is used to explain the driving control of the backup rollers 18A, 18B. For explaining in an easily-understood manner, the drivers that respond to the driving sources and drive each timing belt, are replaced by the drivers of the solenoids 184, 185.

In the controller 186, shown in FIG. 9, among the backup rollers 18A, 18B, the rotation starting time of the backup roller 18B positioned at the upstream side in the transporting direction is with more delay than the backup roller 18A positioned at the downstream side. In this way, the amount of looseness of the sheet generated between the separating position is changed according to the curl adjustment amount from the control panel 187.

Figure 10:
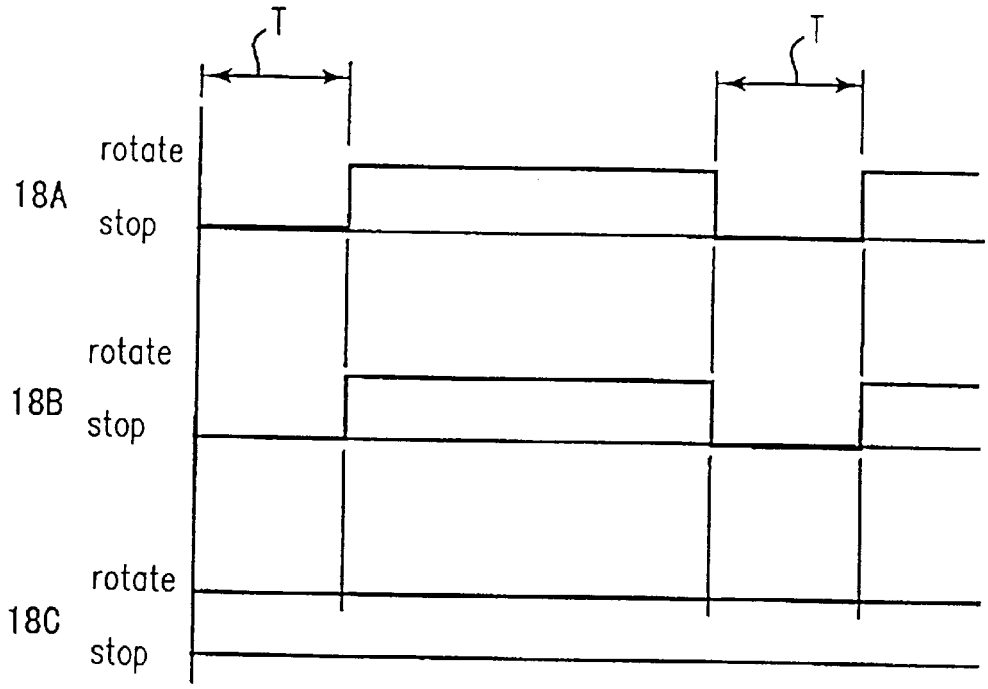
FIG. 10 is a time chart showing the operation timings of the backup rollers of FIG. 6A.
Figure 11A:
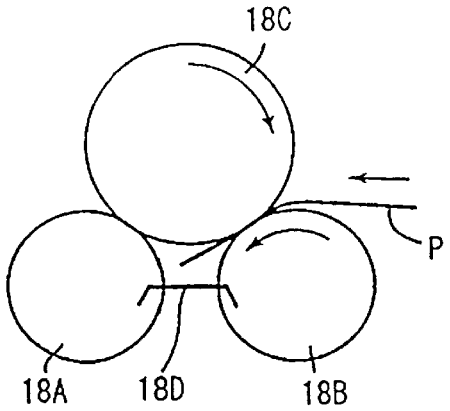
FIGS. 11A to 11D show the operations of the backup rollers to loosen the sheet according to the operation timing of FIG. 10.
Figure 11B:
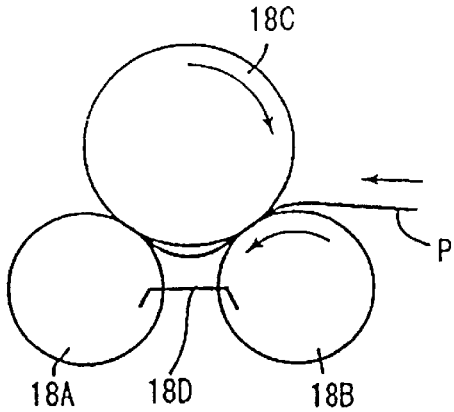
Figure 11C:
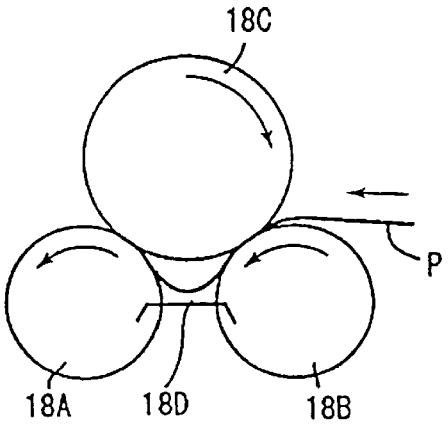
Figure 11D:
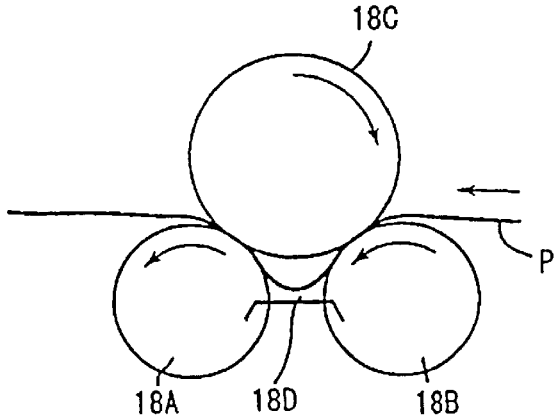

FIG. 10 is a time chart showing the delayed rotation starting time of the backup roller 18B with respect to the backup roller 18A. In FIG. 10, the delay time T is set according to the curl adjustment amount.

Because the embodiment is constructed with the structure described above, after the sheet has arrived the de-curl mechanism 18, the sheet is affected to move by the friction from the backup rollers 18A, 18B, which have larger friction with respect to the transporting roller 18C. Then the sheet can slide on the circumference of the transporting roller 18C.

When the rotation starting times of the backup rollers 18A, 18B differ from each other, a looseness is generated on the sheet, as shown in FIGS. 11A~11D.

Referring to FIGS. 11A~11D, after the sheet has arrived the nip portion of the backup roller 18A and the transporting roller 18C, the sheet is clamped and transported by the press-contact of the rollers (shown in FIG. 11A), and the tip end of the sheet moves toward the backup roller 18B. At this time, the backup roller 18B does not rotate yet. At this time, the interlocking relationship between the transporting roller 18C and the backup roller 18A is not established yet. Therefore, with the frictions between the transporting roller 18C and the backup roller 18A with respect to the sheet, the sheet can slide on the circumference of the backup roller 18A then can rotate.

Once the tip end of the sheet arrives the nip portion of the backup roller 18A and the transporting roller 18C, the sheet is pressed from the back side. At this time, the friction with respect to the transporting roller 18C is smaller than that with respect to the backup roller 18A. Then, the sheet can slide on the circumference of the transporting roller 18C while moving toward the nip portion of the backup roller 18B. Thus, the looseness of the sheet is generated between the backup rollers 18A, 18B (referring to FIG. 11B).

Once the pre-determined delay time T passed, the backup roller 18B starts rotating. Therefore, the sheet is clamped and transported by the nip portion of the backup roller 18C and the transporting roller 18B in a way that the looseness of the sheet is maintained till the rotation starting time, (referring to FIGS. 11C, 11D).

In this embodiment, the sheet can slide and the amount of looseness can be changed according to the curl adjustment amount by varying the operation timings of the backup rollers. Thus, the curl can be efficiently straightened.

Still another embodiment related to the present invention will be explained as follows. In this embodiment, the relationship in frictions of the transporting roller 18C and the backup rollers with respect to the sheet is same as FIGS. 11A~11D. The feature of this embodiment is that the circumferential-speeds of the transporting roller 18C and the backup rollers can be changed.

Figure 12:
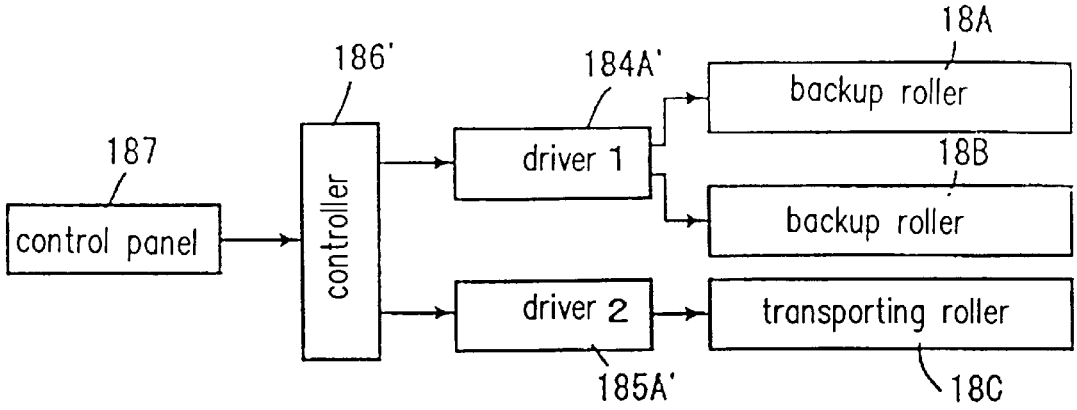
FIG. 12 is a blocking diagram showing the driving controller changing the circumferential-speeds of the backup rollers.

FIG. 12 is a block diagram showing the controller (shown as numeral reference 186' for convenience) driving and controlling the transporting roller 18C and the backup rollers 18A, 18B. The backup rollers 18A, 18B, same as that shown in FIG. 5, are driven to rotate through the timing belt, driven by the same one driving source, and the transporting roller 18C is driven to rotate by other driving source different from that of the backup rollers 18A, 18B.

The input side of the controller 186' is connected to the control panel 187, and the output side of the controller 186' is connected to the driver (shown as the numeral reference 184A' for convenience) of the driving source corresponding to the backup rollers 18A, 18B and the driver (shown as the numeral reference 185A' for convenience) of the driving source corresponding to the transporting roller 18C.

In the controller 186', the circumferential-speeds of the backup rollers 18A, 18B and the relative circumferential-speeds with respect to the transporting roller 18C are changed according to the curl adjustment amount input to the control panel 187. Now when setting the circumferential-speed of the backup rollers 18A, 18B to be V1 and setting the circumferential-speeds of the transporting roller 18C to be V2, the relationship between V1 and V2 can be set as one of the conditions below.

$$V2>V1 \quad (1)$$

$$V2<V1 \quad (2)$$

When the relationship is as condition (1), because the friction between the transporting roller and the sheet is smaller than that among the backup rollers 18A, 18B and the sheet, the circumference of the transporting roller 18C can slide on the surface of the sheet. In this way, because the transporting roller 18C is the member of cooling the sheet, the sheet can have more chance to be in contact with the new circumference equaling to the cooling face with respect to the sheet. Therefore, the endothermal phenomenon is obvious and the temperature drop of the sheet can be encouraged to recover the rigidity of the sheet.

When the relationship is as condition (2), the sheet will have less chance to be in contact with the new circumference of the transporting roller 18C than the condition (1). In this way, the endothermal phenomenon in more restricted than the condition (1). Therefore, the sheet can be cooled with different effects.

Because this embodiment is constructed by the structure described above, after the sheet has arrived the de-curl mechanism 18, the cooling effects can be varied according to the curl amount. Especially, when the curl adjustment amount inputted to the control panel is large, the condition (1) will be set in order to promote cooling the sheet, then recover the rigidity of the sheet itself.

Once the condition (1) is set, the transporting roller 18C rotates on the surface of the sheet, and the new circumference, the face with lower temperature will have more chance to be in contact with the sheet's surface. Therefore, the cooling can be promoted to drop the temperature. Because the flexural rigidity of the sheet recovers due to the temperature drop, when the sheet passes the de-curl mechanism and is transported toward the reversing passage, the sheet can be prevented from curling due to the shape of the reversing passage.

Figure 13A:
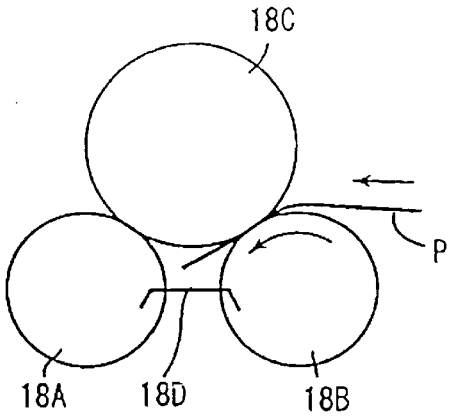
FIGS. 13A~13D show a modification example of the sheet transporting in case when the driving controller shown in FIG. 12 is used.
Figure 13B:
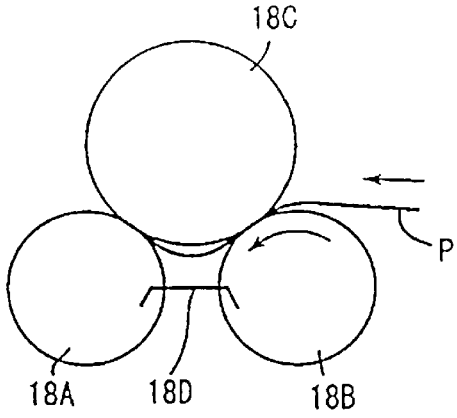
Figure 13C:
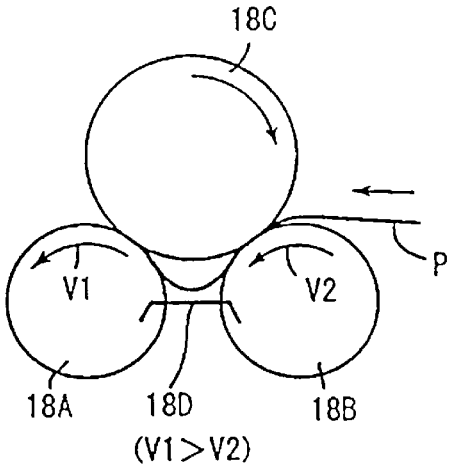
Figure 13D:
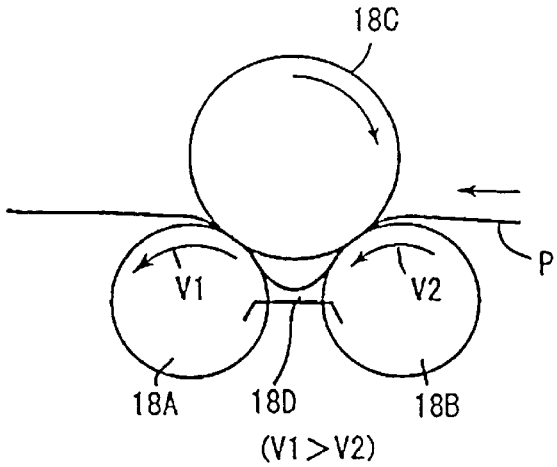

The temperature drop of the sheet due to the relationship of the circumferential-speeds in this embodiment is required same as the embodiment shown in FIGS. 6A, 6B that not obstructing the soft toner from performing osmosis toward the sheet. In addition, when the operation timing is set between the backup rollers 18A, 18B same as the embodiment shown in FIGS. 11A~11D further with the set of the circumferential-speed relationship among the transporting roller 18C and the backup rollers 18A, 18B, the rotation starting time of the transporting roller 18C can also match that of the backup roller 18A, as shown in FIGS. 13A, 13B. During the tip end of the sheet, which has arrived the de-curl mechanism 18, arriving the nip portion between the backup roller 18A and the transporting roller 18C, the backup roller 18A and the transporting roller 18C are stopped in advance (referring to FIGS. 13A, 13B). As shown in FIG. 13C, when the amount of looseness of the sheet is generated between the backup rollers 18A, 18B, the backup roller 18A and transporting roller 18C will rotate. With the operation steps, even the backup roller 18A and the transporting roller 18C stop due to the frictions between the backup roller 18A and the transporting roller 18C against the sheet, the sheet can still move due to the frictions between the backup roller 18B and the sheet. Therefore, the looseness of the sheet can be generated according to the curl adjustment amount due to the operation timing set between each roller.

In this embodiment, especially when the sheet is transported toward the reversing passage to form images onto the two faces of the sheet after the sheet has been fixed, the curl in the reversing passage can be restricted by promptly cooling the sheet. Because the transporting roller 18C made of cooling member is arranged on the side contacting with the toner supported by the sheet, the toner will be cooled and solidified by promptly cooling of the transporting roller 18C. Therefore, the image can be prevented from being blurred and the toner can be prevented from being careless transferred.

With the structure of the present invention, one of the rollers constructing the de-curl mechanism is made of the cooling member, the sheet can be forced to cool. In this way, with preventing the curl-straightening structure from being reheated, the re-curl can be prevented.

With the structure of the prevent invention, because the cooling member is the roller positioned at the side facing and contacting the toner or at the side bending the sheet toward the curl-straightening direction, the sheet can be forced to cool to prevent the toner from being soften again and then the heat offset can be prevented. With capable of dissipating the accumulated heat, the flexural rigidity of the sheet can be prompted to recover then the habit of bending can be prevented. In this way, the sheet can be prevent from being re-curled in the de-curl mechanism and can be prevented from the hot offset.

With the structure of the present invention, the cooling member is the heat pipe capable of setting the forcing cooling cycle, and the heat pipe itself can be forced to radiate by the cooling fan, the accumulated heat of the sheet can be radiated instantly. In this way, the flexural rigidity of the sheet, softened to hang down, can recover to obstruct the sheet form being re-curled and the hot offset due to the re-softening of the toner can be prevented.

With the structure of the present invention, the material of the heat pipe is in directly contact with the sheet to cool, the heat of the sheet can be efficiently taken out then the sheet temperature can be efficiently dropped. In this way, differing from the conventional structures, with the structure of the present invention, the hot offset can be prevented without the offset preventing structure, and the sheet can recover to its original flexural rigidity.

With the structure of the present invention, the cooling capacity can be set according to the heat pipe temperature, the sheet can be efficiently prevented from being re-curled and hot offset.

With the structure of the present invention, in the heat pipe, the radiating fan is connected to the dehumidifying unit, then the before feeding the sheet, the sheet can be dehumidified in advance. In this way, the curl affected by the humidity of the sheet can be obstructed in advance.

With the structure of the present invention, the tension of the sheet passing the de-curl mechanism is higher at the exit side than that at the entrance side, then the sheet is stretched between the entrance side and the exit side. Thus, the press-contact force between the rollers, facing and clamping the transporting passage clamping, can be increased. In this way, with high contact force toward the cooling member, the sheet can be cooled rapidly. Especially, among the rollers arranged abreast in the de-curl mechanism, the rotating speed at the downstream side in the ejecting direction can be increased higher than that at the upstream side by only changing the outer diameter of the roller positioned at the downstream side. Thus, the contact condition between the sheet and the cooling member can be improved with simple structure without setting a special speeding mechanism.

With the structure of the present invention, in case when the de-curl mechanism is installed on the sheet ejecting device, the sheet can be prevented from being re-curled in the de-curl mechanism, and the bad transporting and bad images due to the offset can also be prevented.

With the structure of the present invention, before the sheet, which tends to accumulate heat then to be softened due to fixing, is led into the reversing transporting passage, the sheet is cooled in advance to recover its flexural rigidity. In this way, the habit of curling can be restricted in advance when the sheet is bent in the reversing transporting passage during moving. Thus, the re-curl in the reversing treatment can be prevented in advance.

With the structure of the present invention, the separating distance of the backup rollers arranged along the circumference of the transporting roller can be changed according to the curl amount of the sheet, the amount of looseness of the sheet generated between the backup rollers can be changed. In this way, the curl-straightening amount can be set according to the curl amount by setting the curvature according to the amount of looseness generated toward reverse to the curl-generating direction between the backup rollers. Thus, no matter what amount of the curl is, the curl can be straightened.

With the structure of the present invention, the backup rollers are constructed by subdivision roller units in the axial direction and are set to be arranged abreast in the circumference of the transporting roller in a way that the roller units are arranged with position-shit. In this way, the flexural rigidity of the sheet in the axial direction of the sheet can be increased. Because the operation timings of the backup roller can be changed, the amount of looseness of the sheet generated during moving can correspond the curl adjustment amount. Thus, the curl of the sheet can be efficiently straightened.

In the structure of the present invention, the friction between the transporting roller and the sheet is set smaller than that between the backup rollers and the sheet. The transporting roller is used as a cooling member. Additionally with recovery of the rigidity of the sheet due to the temperature drop under the condition of differing the operation timings between the backup rollers, the amount of looseness of the sheet can be created according to the adjustment amount by differing the operation timings. In this way, no matter what curl amount is, the curl can be straightened with the simple structure by adjusting only operation timing.

With the structure of the present invention, the circumferential-speeds of the transporting roller and the backup rollers with respect to the sheet can be changed, then the cooling effect of the transporting roller can be changed. In this way, the tendency to drop the temperature of the sheet due to the cooling effects can correspond to the curl amount of the sheet. Thus, the re-curl can be prevented.

With the structure of the present invention, the sheet can be cooled and curl-straightened at the same time without increasing the space of the device or increasing the cost.

With the structure of the present invention, the structure comprises the transporting roller, which can cool the sheet passing from the fixing unit toward the reversing device in the transporting passage during transporting the sheet, and the backup rollers, which are arranged along the circumference of the transporting roller and can clamp and transport the sheet imitating the circumference of the transporting roller. Then the sheet can be cooled to recover its original rigidity before the sheet being reversed. Thus, the re-curl due to the shape of the transporting passage can be prevented. Especially, in case when the shape of the transporting passage is formed in a way that the sheet is reversed and moves toward the feeding unit again, the sheet moving toward the reversing device is cooled by the transporting roller. Then the images supported by the sheet can be cooled to solidify, and the bad images such as image burl can be prevented in advance.

While the present invention has been described with a preferred embodiment, this description is not intended to limit our invention. Various modifications of the embodiment will be apparent to those skilled in the art. It is therefore contemplated that the appended claims will cover any such modifications or embodiments as fall within the true scope of the invention.

What claimed is:

1. A sheet ejecting device, used for a heat member and a press member arranged opposite to each other in a transporting passage of a sheet that supports a toner image, and the sheet where the toner image is fixed by heating and pressing, is ejected, comprising a de-curl mechanism, further comprising:

a first roller, positioned at a side facing and contacting with the toner image supported by the sheet; and a plurality of second rollers, arranged abreast on a circumference of the first roller and contacting the circumference of the first roller, and clamping and transporting the sheet in a way that the sheet imitating the circumference of the first roller, wherein the de-curl mechanism bends the sheet reverse to a curl-generating direction of the sheet to straighten a curl, and one of the rollers constructing the de-curl mechanism is made of a cooling member.

2. The sheet ejecting device of claim 1, wherein a cooling member is used to the first roller positioned at the side facing and contacting the toner image.

3. The sheet ejecting device of claim 1, wherein the cooling member is a roller bending the sheet reverse to the curl-generating direction.

4. The sheet ejecting device of claim 1, wherein the cooling member is made by a heat pipe.

5. The sheet ejecting device of claim 4, wherein a material, serving as a base of the heat pipe, is used to directly contact the sheet to cool the sheet.

6. The sheet ejecting device of claim 4, wherein the heat pipe comprises a radiating fan arranged on an end of an axial direction of the heat pipe, and the radiating fan is cooled by a cooling fan arranged near the radiating fan.

7. The sheet ejecting device of claim 6, wherein the cooling fan is capable of controlling an airflow according to a temperature of the heat pipe.

8. The sheet ejecting device of claim 6, wherein the radiating fan of the heat pipe is connected to a sheet dehumidifying unit.

9. The sheet ejecting device of claim 1, wherein a tension of the sheet, passing the de-curl mechanism, is changed at an entrance side and an exit side of the de-curl mechanism.

10. The sheet ejecting device of claim 9, wherein the tension of the sheet is larger at the exit side of the de-curl mechanism than that at the entrance side.

11. The sheet ejecting device of claim 9, wherein among the second rollers, a rotating speed of the second roller positioned at a downstream side in an ejecting direction of the sheet is larger than that of the second roller positioned at an upstream side.

12. The sheet ejecting device of claim 11, wherein among the second rollers, an outer diameter of the second roller positioned at the downstream side in the ejecting direction is large than that of the second roller positioned at the upstream side.

13. An image forming apparatus comprising one of the sheet ejecting devices of claims 1 to 12.

14. The image forming apparatus of claim 13, wherein the de-curl mechanism is arranged before the sheet, transported after being fixed, is led into a sheet reversing passage.

15. A curl eliminating device, comprising:

a transporting roller, arranged in a sheet transporting passage;

a plurality of backup rollers, arranged abreast along a circumference of the transporting roller, and press-contacting the transporting roller during rotating, wherein the curl eliminating device clamps and transports the sheet in a way that the sheet imitating a shape of the circumference of the transporting roller, and the backup rollers are separately arranged along the circumference of the transporting roller, and a separating distance is set to be changeable, and the separating distance is set according to a curl amount of the sheet.

16. A curl eliminating device, comprising:

a transporting roller, arranged in a sheet transporting passage;

a plurality of backup rollers, arranged abreast along a circumference of the transporting roller, and press-contacting the transporting roller during rotating, wherein the curl eliminating device clamps and transports the sheet in a way that the sheet imitating a shape of the circumference of the transporting roller, and the backup rollers comprises a plurality of roller units, subdivided in axial direction of the backup rollers, are arranged in the axial direction with position-shift, and an operation timing of each backup roller can be changed.

17. The curl eliminating device of claim 16, wherein the transporting roller is used as a sheet cooling member, and a friction between the transporting roller and the sheet is set smaller than that between the backup rollers and the sheet.

18. A curl eliminating device comprising:

a transporting roller, arranged in a sheet transporting passage;

a plurality of backup rollers, arranged abreast along a circumference of the transporting roller, and press-contacting the transporting roller during rotating, wherein the curl eliminating device clamps and transports the sheet in a way that the sheet imitating a shape of the circumference of the transporting roller, and the transporting roller is used as a sheet cooling member, and a friction between the transporting roller and the sheet is set smaller than that between the backup rollers and the sheet, and relative circumferential-speeds of the transporting roller and the backup rollers can be changed.

19. An image forming apparatus, comprising one of the curl eliminating devices of claims 15 to 18, and with using the curl eliminating device, the transporting roller cooling the sheet.

20. An image forming apparatus, comprising:

a fixing device, using a heat member and a press member arranged opposite to each other in a transporting passage of a sheet, supporting a toner image, to fix the sheet by heating and pressing and then to eject the fixed sheet;

a reversing device, reversing and transporting the sheet ejected from the fixing device;

a transporting roller, having a forcing cooling structure to construct a cooling member to cool the sheet during transporting, is arranged in the transporting passage, going toward the reversing device from the fixing device, and a plurality of backup rollers, arranged abreast on a circumference of the transporting roller, clamping and transporting the sheet in a way that the sheet imitating a shape of the circumference of the transporting roller, wherein the transporting roller and the backup roller are arranged in a way that can bend the sheet opposite to a curl-generating direction of the sheet, which is ejected from the fixing unit, and then to move the sheet toward the reversing device.

* * * * *